US007037247B1

(12) United States Patent
Bergeron

(10) Patent No.: US 7,037,247 B1
(45) Date of Patent: May 2, 2006

(54) MECHANICAL DEVICE USED TO MAKE DIFFERENT EXERCISES ON THE GROUND

(76) Inventor: Florent Bergeron, 6045 de la Griotte, apt. 124, Quebec (CA)

( * ) Notice: Subject to any disclaimer, the term of this patent is extended or adjusted under 35 U.S.C. 154(b) by 1028 days.

(21) Appl. No.: 09/695,272

(22) Filed: Oct. 25, 2000

(51) Int. Cl.
*A63B 71/00* (2006.01)

(52) U.S. Cl. ..... 482/148; 482/142

(58) Field of Classification Search ..... 482/148, 482/45, 44, 92–94, 142, 95, 907, 127, 121; 5/3; D24/183; 6/633; 108/16; 473/496
See application file for complete search history.

(56) References Cited

U.S. PATENT DOCUMENTS 6,110,083 A * 8/2000 Riser ..... 482/142

* cited by examiner

*Primary Examiner*—Gregory L. Huson
*Assistant Examiner*—L. Amerson

(57) ABSTRACT

A transportable exercising apparatus comprising a frame at which is secured a structure supporting the user's body while its hand or foot is in use, and that can be adjusted according to user's needs.

1 Claim, 9 Drawing Sheets

MECHANICAL DEVICE USED TO MAKE DIFFERENT EXERCISES ON THE GROUND

BACKGROUND OF THE INVENTION

1. Field of the Invention

The invention concerns an exercising apparatus that can be adjusted according to user's needs.

2. Description of Related Art

It has been recognized as desirable to provide an apparatus for exercising the muscles in general.

A search of prior art records has unveiled the following patents:

1. U.S. Pat. No. 2,436,987 issued in 1948 to Bailleaux; and
2. U.S. Pat. No. 3,117,782 issued in 1964 to Johnston.

The patent issued in 1964 to Johnston is probably the most relevant. As can be seen, the problem encountered with use of the physical exercise apparatus to Johnston is that, the tension of the steel wires is not adjustable when the user makes different exercises on the ground, and the longitudinal structure is not adjustable at different positions.

To overcome the above-mentioned problem, in accordance with the teachings of the invention, there is disclosed a transportable exercising apparatus which is relatively simple and economical to manufacture.

SUMMARY OF THE INVENTION

In accordance with the present invention, a transportable exercising apparatus that can be adjusted according to user's needs, and which comprises a frame at which is arranged four legs. Two parallel bars are mounted on the frame for securing a structure having a top end for supporting the user's body while its hand or foot is in use, and that can be adjusted so as to be lowered or raised. The top end is formed thereof two sections at which the first section is mounted on the parallel bars and attached therewith the second section by two hinges so as to pivot, as depicted in FIG. 2.

According to the preferred embodiment of the present invention, an arm having a first end secured at the frame by a pivot therein a hole and a second end having an attachment for securing a first end of a first cable to be engaged to cam of a large pulley fitting therewith a support structure secured at the frame and coupled therewith for allowing the pivotal motion of the arm secured at a first end of a spring by a pin therein a hole and a second end of the spring is secured to an attachment by a pin therein a hole, and for adjusting the tension of the spring the user must displace the spring at a desired hole located at one end portion being formed as integral part of the frame and to be locked therethrough by a spring pin. A plate being formed as integral part of the frame and having an aperture for receiving a rod being formed at the bottom end of a bar. The plate includes an attachment for receiving a spring pin to be engaged therethrough a desired hole formed on the plate for locking a first end of a bar at a desired position, and a second end is adapted for receiving a support member being fixed to a rotary part. A second cable extends through the bar so as to be engaged therein a groove rim of the large pulley and to a small pulley mounted directly therein the rotary part so as to be pulled at any position. The small pulley having a hole for receiving a bolt passing through a hole of the rotary part supporting the small pulley being connected thereby a nut. A handle being formed as end portion of the second cable is adapted for receiving hand or foot and to be fitted with a cable holder. A U-shaped bracket is secured at the frame for supporting a roller to allow the displacement of the apparatus.

DESCRIPTION OF THE DRAWINGS

The accompanying drawings show illustrative embodiments of the present invention from which the features and advantages will be readily apparent.

DETAILED DESCRIPTION OF THE INVENTION

Figure 1:
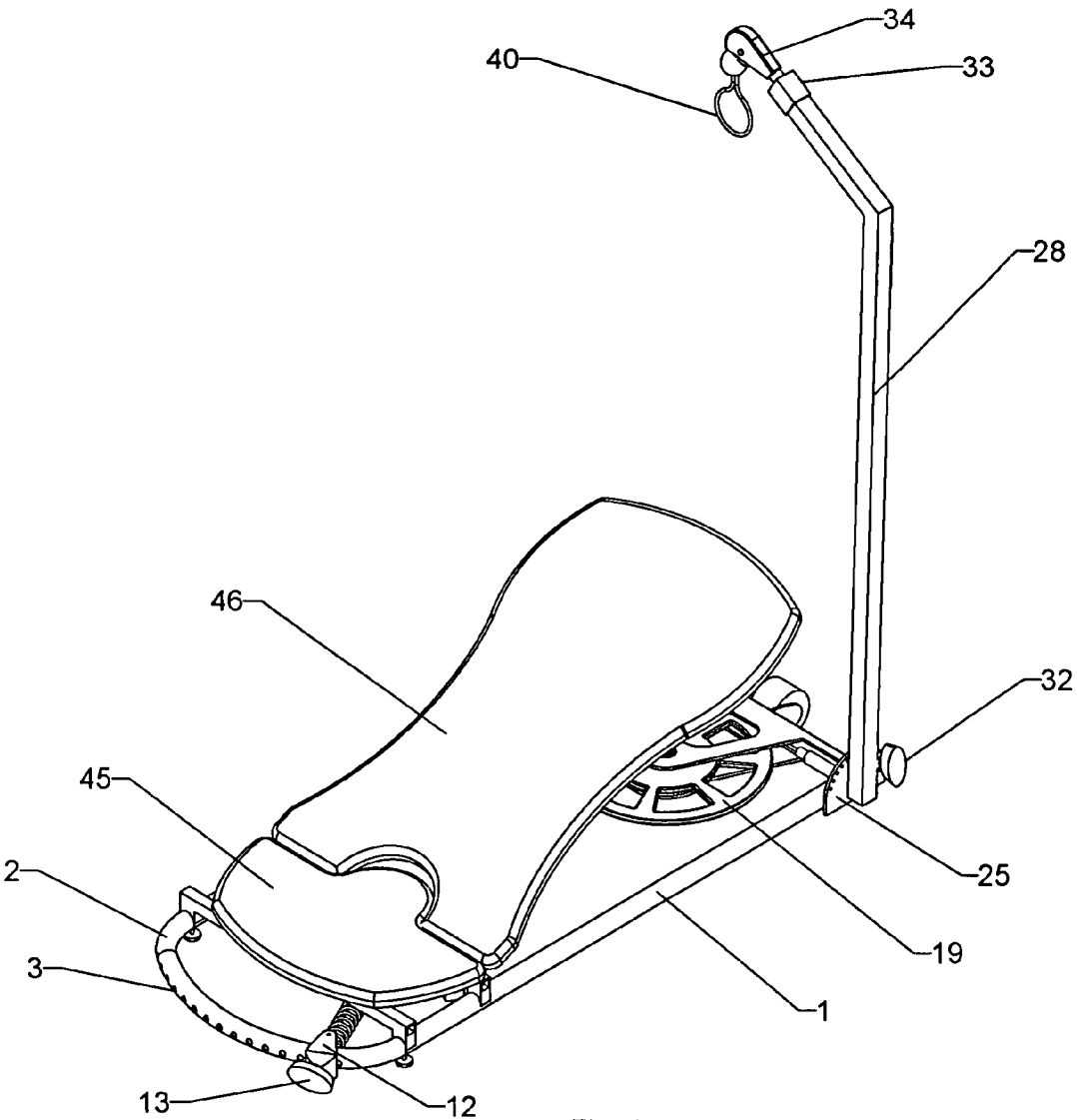
FIG. 1 is a perspective view of the present invention.
Figure 2:
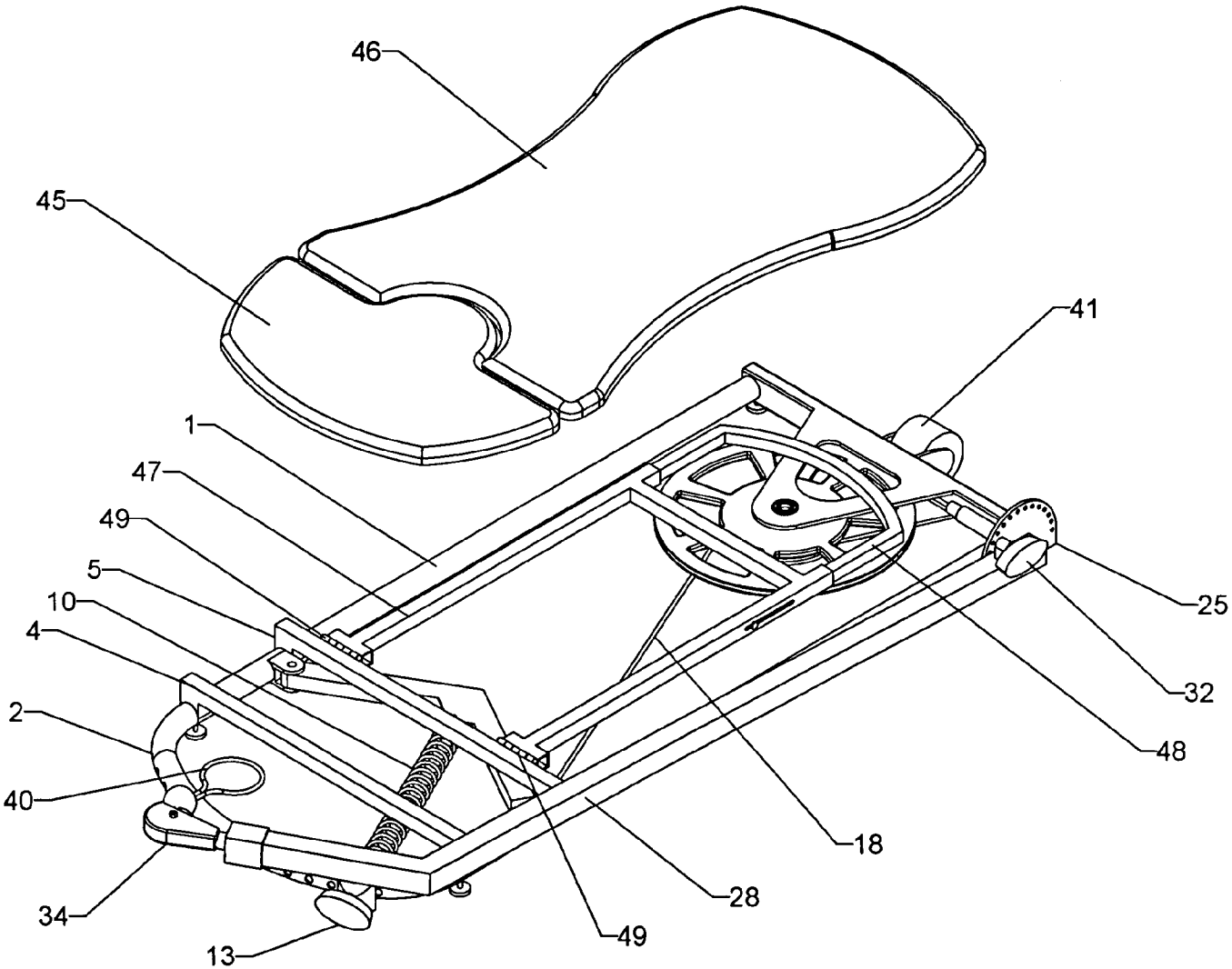
FIG. 2 is a top view of the present invention.
Figure 3:
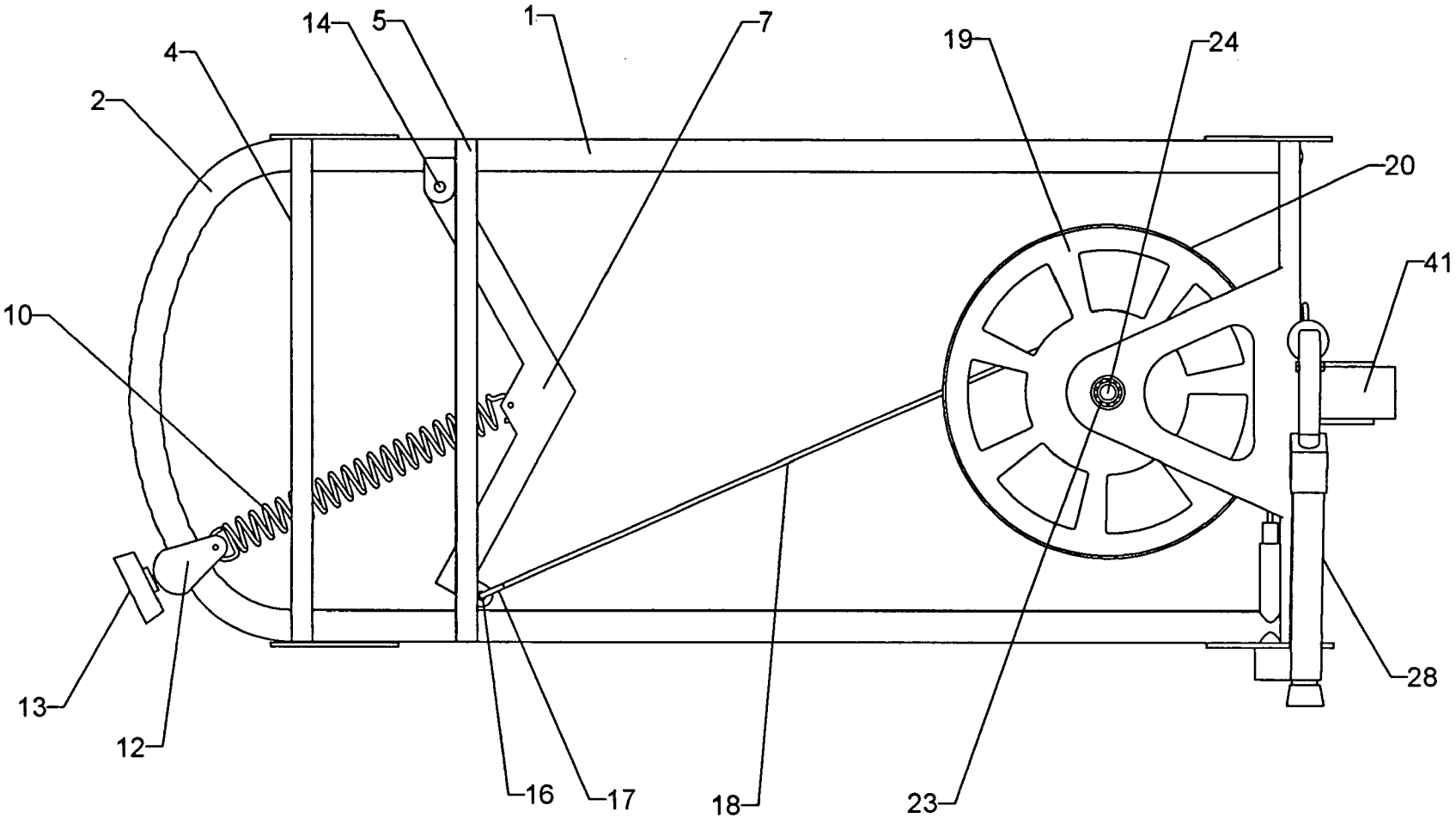
FIGS. 3, 4 are detail views illustrating the operation of the present invention.
Figure 4:
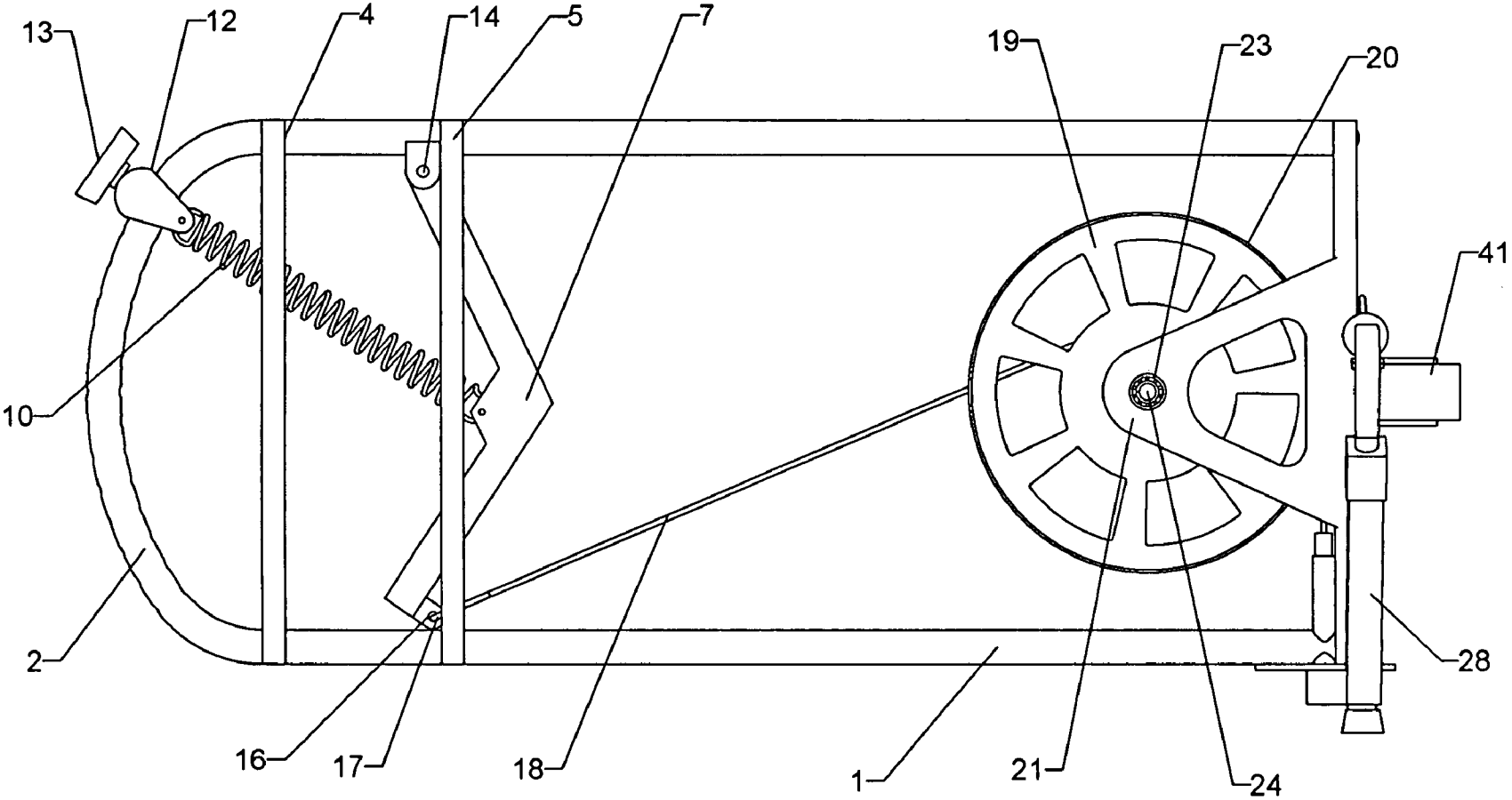
Figure 5:
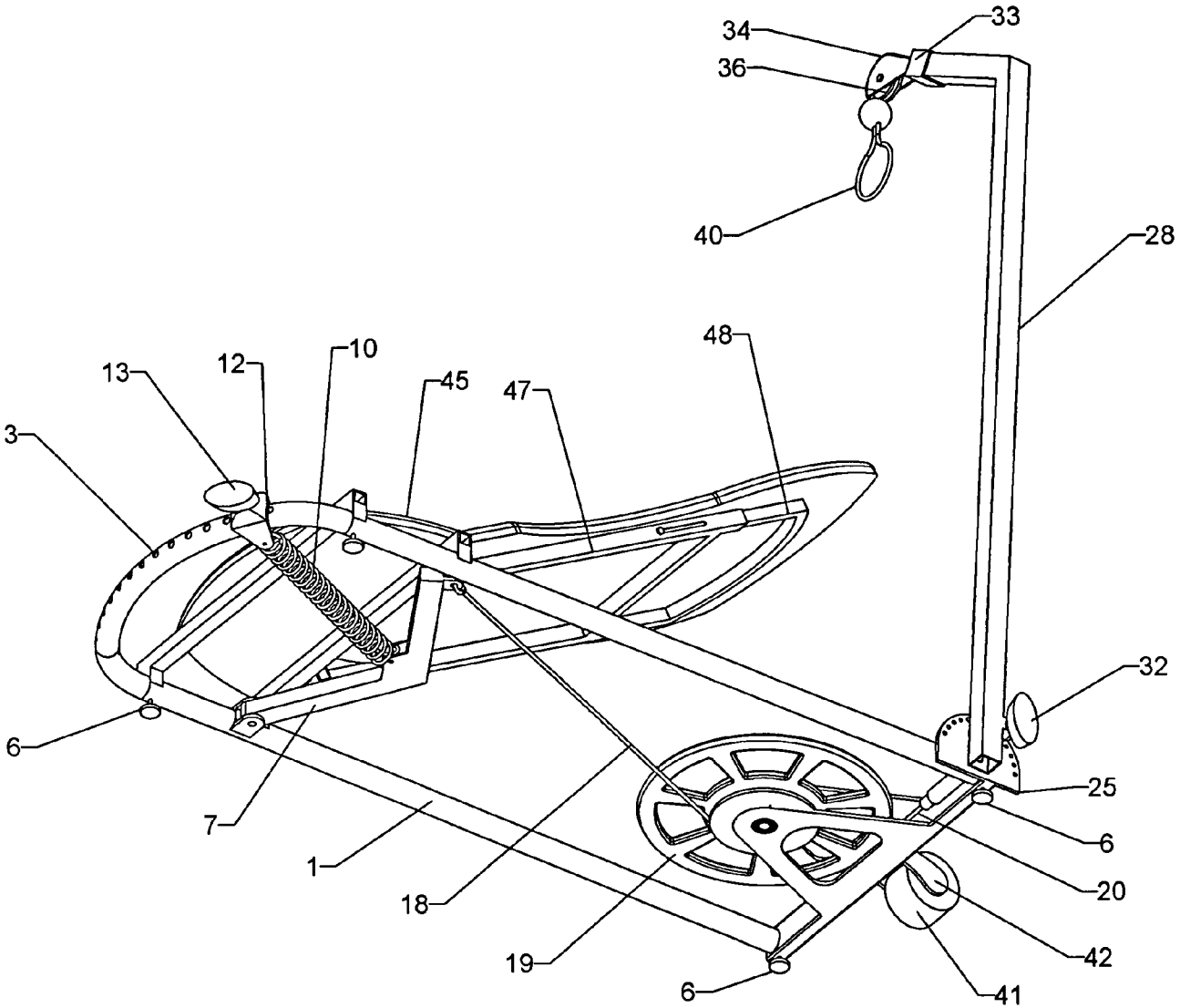
FIG. 5 is a bottom view of the present invention.
Figure 6:
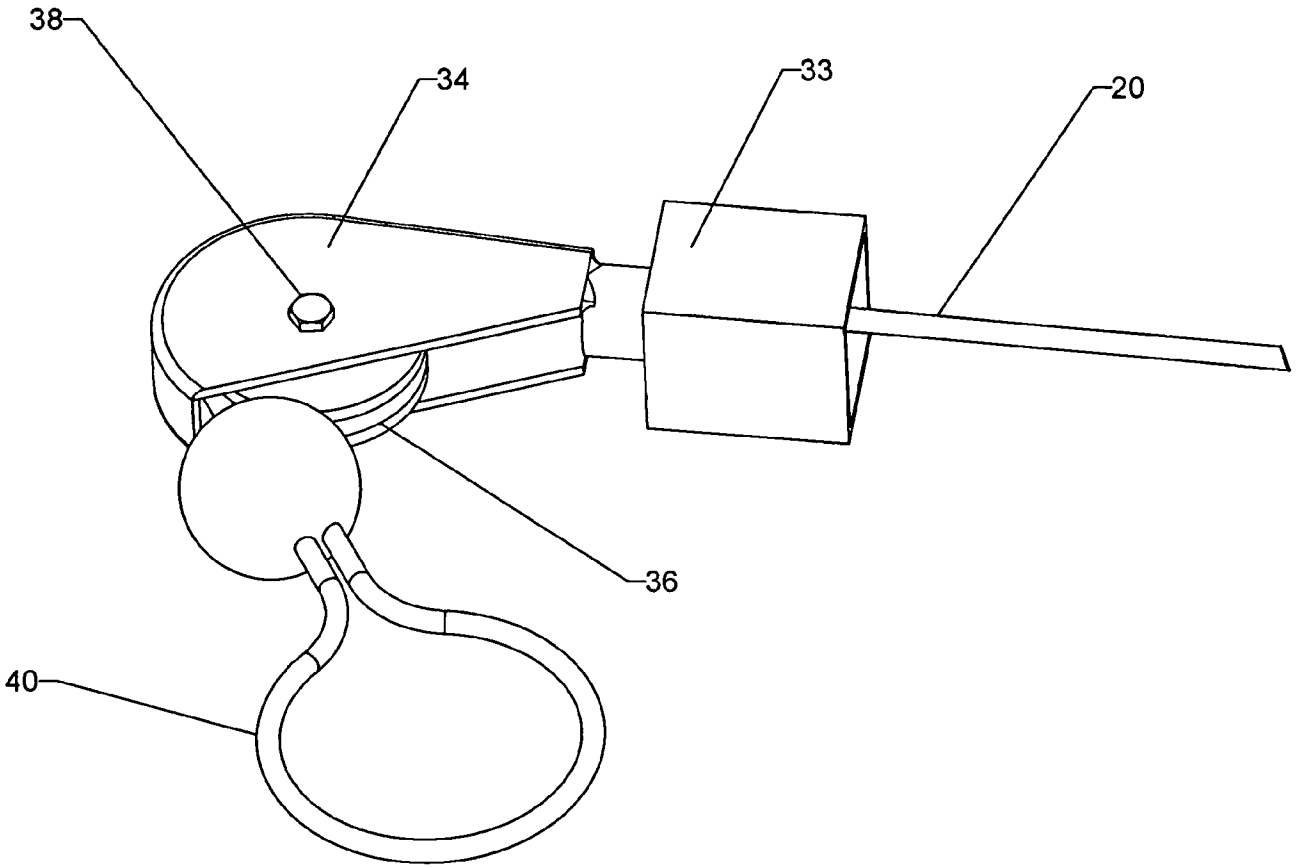
FIGS. 6, 7, 8 are detail views of the components according to the present invention.
Figure 7:
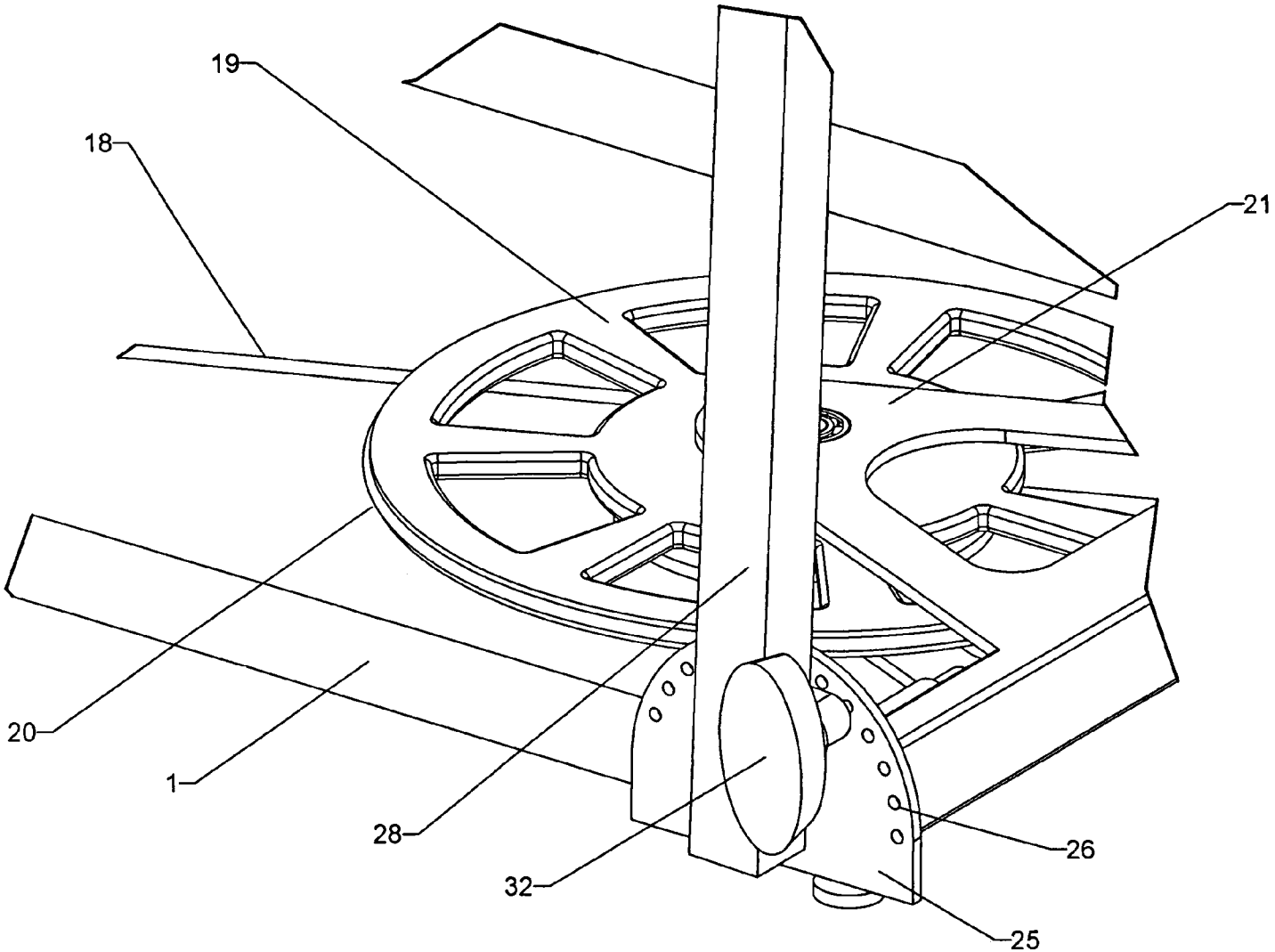
Figure 8:
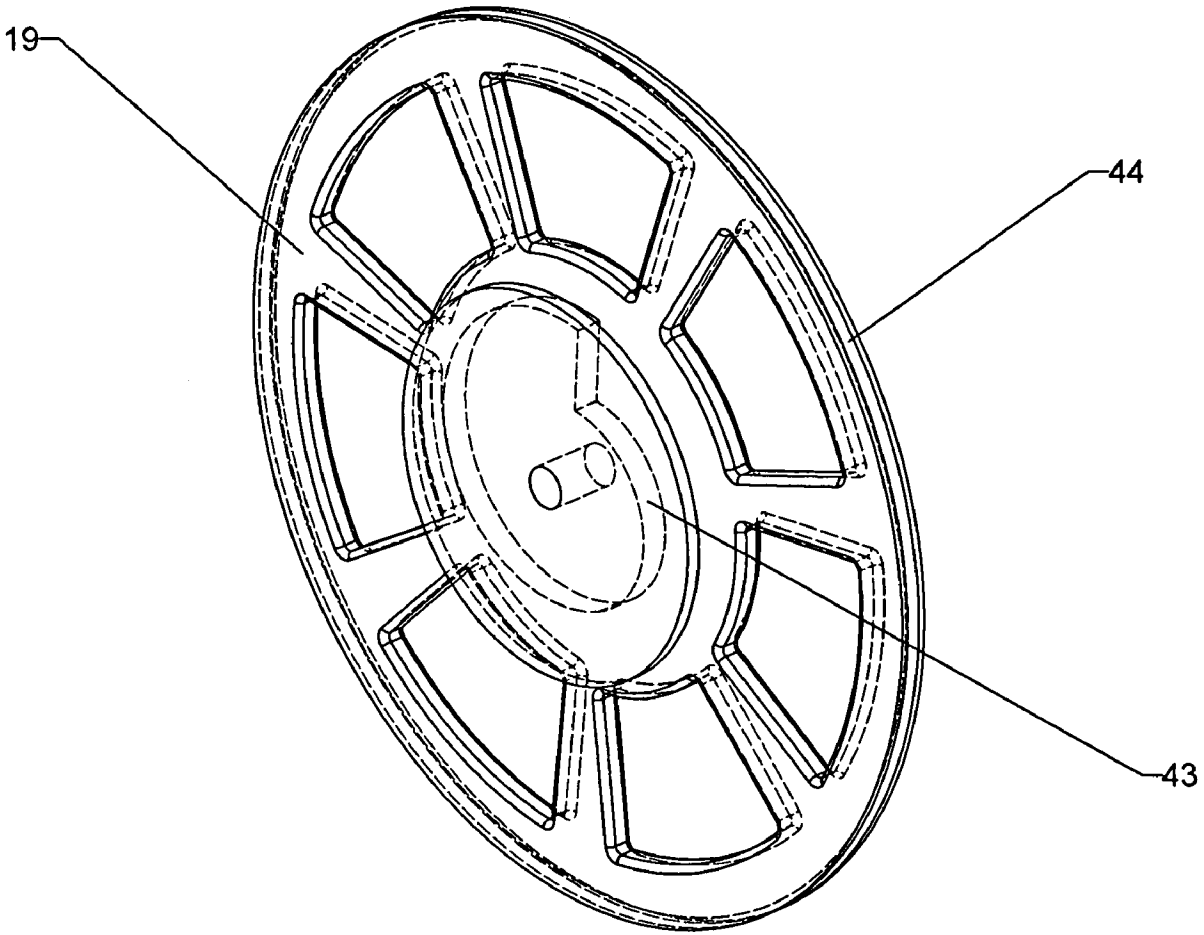
Figure 9:
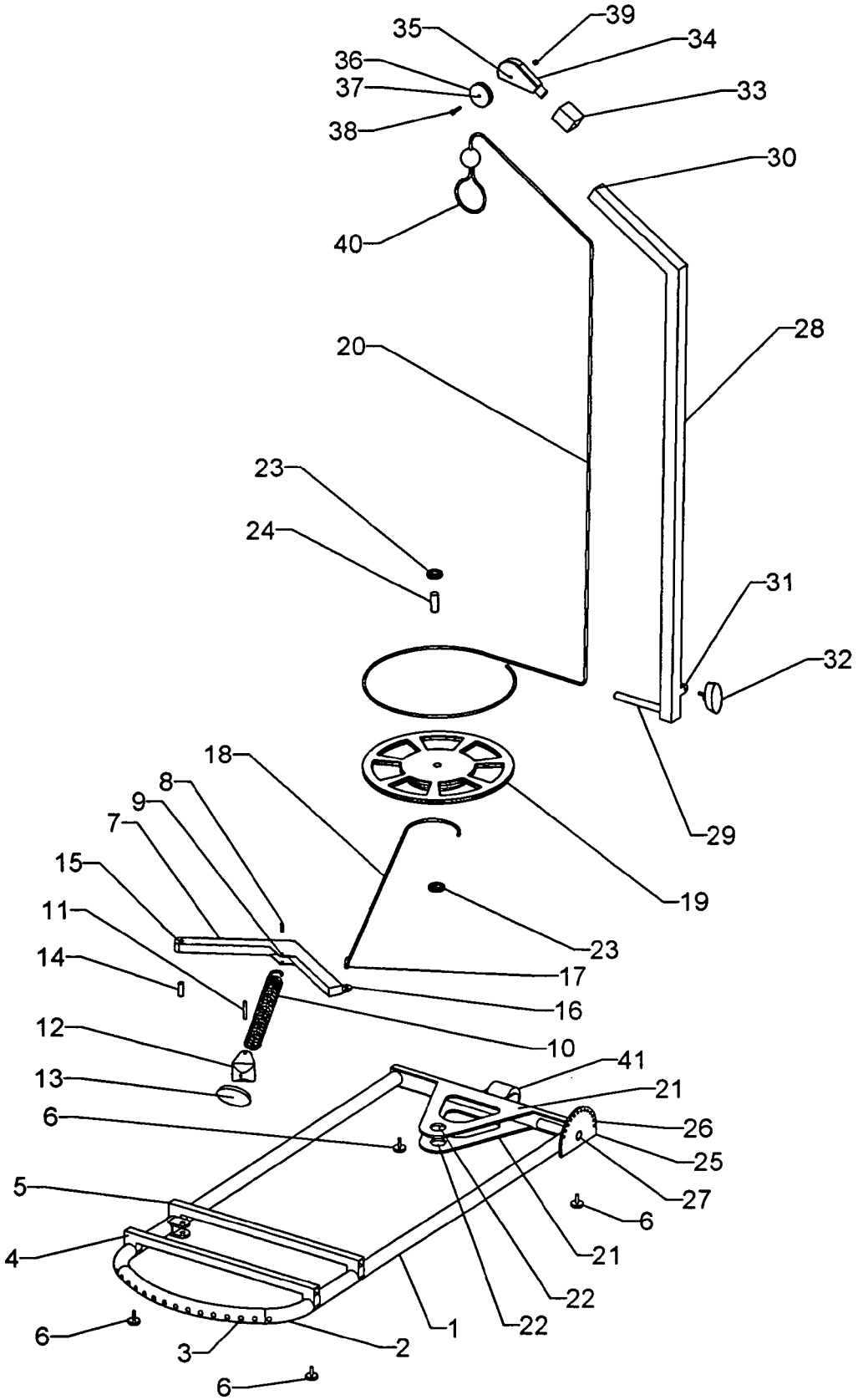
FIG. 9 is an exploded view showing the components in position for assembly.

A transportable exercising apparatus according to a preferred embodiment of the present invention, comprises a frame (1) at which is arranged four legs (6). Two parallel bars (4)(5) are mounted thereon the frame (1) for securing a structure (48) having a top end for supporting the user's body while its hand or foot is in use, and that can be adjusted so as to be lowered or raised. The top end is formed thereof two sections (45)(46) at which the first section (45) is mounted thereon the parallel bars (4)(5) and attached therewith the second section (46) by two hinges (49) so as to pivot, as depicted in FIG. 2.

According to the preferred embodiment of the present invention, an arm (7) having a first end secured at the frame (1) by a pivot (14) therein a hole (15) and a second end having an attachment (16) for securing a first end (17) of a first cable (18) to be engaged to cam (43) of a large pulley (19) fitting therewith a support structure (21) secured at the frame (1) and coupled therewith (21)(23)(24) for allowing the pivotal motion of the arm (7) secured at a first end of a spring (10) by a pin (8) therein a hole 9 and a second end of the spring (10) is secured to an attachment (12) by a pin (11) therein a hole, and for adjusting the tension of the spring (10) the user must displace the spring (10) at a desired hole (3) located at one end portion (2) being formed as integral part of the frame (1) and to be locked through by a spring pin (13). A plate (25) being formed as integral part of the frame (1) and having an aperture (27) for receiving a rod (29) being formed at the bottom end of a bar (28). The plate (25) includes an attachment (31) for receiving a spring pin (32) to be engaged therethrough a desired hole (26) formed thereon the plate (25) for locking a first end of the bar (28) at a desired position and a second end (30) is adapted for receiving a support member (33) being fixed to a rotary part (34). A second cable (20) extends through the bar (28) so as to be engaged therein a groove rim (44) of the large pulley (19) and to a small pulley (36) mounted directly therein the rotary part (34) so as to be pulled at any position. The small pulley (36) having a hole (37) for receiving a bolt (38) passing through a hole (35) of the rotary part (34) supporting the small pulley (36) being connected thereby a nut (39). A handle (40) being formed as end portion of the second cable (20) is adapted for receiving hand or foot and to be fitted with a cable holder. A U-shaped bracket (42) is secured at the frame (1) for supporting a roller (41) to allow the displacement of the apparatus.

Accordingly, while the preferred embodiments of the invention have been described above, it will be recognized and understood that various modifications may be made in the invention and the appended claims are intended to cover all such modifications which may fall within the spirit and scope of the invention.

I claim:

1. A transportable exercising apparatus, comprising:

a frame;

four legs;

two parallel bars mounted thereon the frame for securing a structure having a top end for supporting the user's body while its hand or foot is in use, and that can be adjusted so as to be lowered or raised, and said top end is formed thereof two sections at which the first section is mounted thereon the parallel bars and attached therewith the second section by two hinges so as to pivot;

an arm having a first end secured to said frame by a pivot therein a hole and a second end having an attachment for securing a first end of a first cable to be engaged to cam of a large pulley fitting therewith a support structure secured to said frame and coupled therewith for allowing the pivotal motion of said arm secured at a first end of a spring by a pin therein a hole and a second end of the spring is secured to an attachment by a pin therein a hole, and for adjusting the tension of said spring the user must displace the spring at a desired hole located at one end portion being formed as integral part of the frame and to be locked therethrough by a spring pin;

a plate being formed as integral part of said frame and having an aperture for receiving a rod being formed at the bottom end of a bar, and wherein the plate includes an attachment for receiving a spring pin to be engaged therethrough a desired hole formed thereon said plate for locking a first end of the bar at a desired position and a second end is adapted for receiving a support member being fixed to a rotary part;

a second cable extends through said bar so as to be engaged therein a groove rim of said large pulley and to a small pulley mounted directly therein the rotary part so as to be pulled at any position, and wherein the small pulley having a hole for receiving a bolt passing through a hole of said rotary part supporting said small pulley being connected thereby a nut;

a handle being formed as end portion of the second cable is adapted for receiving hand or foot and to be fitted with a cable holder; and a U-shaped bracket is secured to said frame for supporting a roller to allow the displacement of the apparatus.

* * * * *